US006599591B1

(12) United States Patent
Scott

(10) Patent No.: US 6,599,591 B1
(45) Date of Patent: Jul. 29, 2003

(54) FLEXIBLE ARTIFICIAL TREE AND METHODS OF MAKING SAME

(76) Inventor: K. Allen Scott, 4192 N. Fremont Rd., Nixa, MO (US) 65714

( * ) Notice: Subject to any disclaimer, the term of this patent is extended or adjusted under 35 U.S.C. 154(b) by 0 days.

(21) Appl. No.: 09/966,714

(22) Filed: Sep. 28, 2001

(51) Int. Cl.[7] ..... A01N 3/00

(52) U.S. Cl. ..... 428/18; 428/17; 428/27; 428/32; 211/196; 211/205

(58) Field of Search ..... 428/18, 17, 27, 428/32; 211/196, 205; D11/118

(56) References Cited

U.S. PATENT DOCUMENTS 5,085,900 A 2/1992 Hamlett
5,190,570 A * 3/1993 He ..... 55/279
D340,003 S 10/1993 Wright et al.
5,340,622 A 8/1994 Curitti
5,492,301 A * 2/1996 Hauser ..... 248/516
5,492,302 A * 2/1996 Odom, Jr. ..... 248/524
6,320,327 B1 * 11/2001 Lavatelli et al. ..... 315/185 S

* cited by examiner

*Primary Examiner*—Deborah Jones
*Assistant Examiner*—Abraham Bahta
(74) *Attorney, Agent, or Firm*—Richard L. Marsh

(57) ABSTRACT

An artificial palm tree having a planar base, a central support, an exterior covering and a separable crown. The central support of the artificial palm tree has one end flexibly affixed to the planar base. An exterior covering constructed around the central support is substantially greater in diameter than the central support and has the separable crown removably affixed to a free end of the central support.

19 Claims, 3 Drawing Sheets

FLEXIBLE ARTIFICIAL TREE AND METHODS OF MAKING SAME

BACKGROUND OF THE INVENTION

1. Field of the Invention

This invention relates to an artificial decorative tree and more specifically to an artificial palm tree that is flexible.

2. Prior Art Statement

Various artificial trees have been produced for the market however, these artificial trees are generally used only indoors as the structure thereof is not sufficient to withstand the outdoor elements. Some artificial trees have been made for outdoor applications, however, these trees are quite heavy and require a substantial artificial tap root in order to remain standing.

For instance, it is known to provide an artificial palm tree trunk of multiple layers of resin impregnated fiberglass laid upon a mandrel. The mandrel is then removed from the trunk and a steel cap having triangular shaped pockets is fitted to the top of the trunk. Palm fronds are inserted into the triangular shaped pockets and the cap and triangular pockets are wrapped with burlap having natural coconut fiber intertwined therein. The artificial palm tree is supported on a support tube buried into the ground. Alternatively, the support tube can be welded to a ⅜" thick steel plate of 25 square feet. For instance, see the U.S. Pat. No. 5,085,900 issued on Feb. 04, 1992, to Bob Hamlett. Multiple layers of resin impregnated fiberglass and a steel support tube make this tree extremely heavy and quite inflexible.

It is also known to provide an ornamental design for an artificial palm tree. For instance, see the U.S. Des. Pat. No. 340,003 issued on Oct. 5, 1993 to Wright, et al. The tree appears to have a substantially straight trunk.

Finally, it is known to provide an artificial palm tree having a base, a body extending upwardly from the base including a rigid trunk and at least one branch segment. For instance, see U.S. Pat. No. 5,340,622 issued on Aug. 23, 1994 to Lenee Curitti. The trunk of this tree is made of solid timbers having a substantial portion of one timber buried into the ground. The tree is quite heavy and inflexible.

Though it has been found that the prior art has examples of artificial trees, the trees are generally intended for indoor use or, when intended for outdoor use, are bulky, heavy and require substantial ground preparation to bury a support post therein to hold the tree rigidly. Thus, the outdoor trees of the art are not flexible and do not truly simulate actual trees subjected to the elements wherein actual trees move with the wind.

SUMMARY OF THE INVENTION

Therefore, it is an object of this invention to provide an artificial tree having a planar base, a central support, an exterior covering and a top wherein the central support has one end flexibly affixed to the planar base, the exterior covering being constructed around the central support and wherein the top portion is affixed to an opposite end of the central support.

It is another object of this invention to provide an artificial tree having a planar base, a central support, an exterior covering and a top portion wherein the top portion is removably affixed to the central support and hence can be removed and replaced with an artificial top portion of a different tree type.

Still another object of this invention is to provide an artificial tree having a planar base, a central support, an exterior covering and a top wherein the top portion simulates the crown of a coconut palm tree having fronds, a bud and a spear leaf and wherein the bud comprises a lower central portion of the crown, the fronds extend generally outwardly from the crown and the spear leaf extends generally upwardly from the bud.

One feature of this invention is to provide an artificial tree having a planar base, a central support, an exterior covering and a top wherein the exterior covering is spaced from the central support with shape defining elements of different size affixed to the central support at random or unequal spacings along the length of the central support and at random or unequal spacings about the periphery of the central support.

A significant feature of this invention is to provide an artificial palm tree having a planar base, a central support, an exterior covering and a separable crown, the central support having one end flexibly affixed to the planar base, the exterior covering constructed around the central support and the separable crown removably affixed to an opposite end of the central support.

One aspect of this invention is to provide an artificial coconut palm tree having a planar base, a central support, an exterior covering and a separable crown wherein the exterior covering comprises a stem portion and a butt portion, the stem portion and the butt portion comprising a trunk portion of the artificial tree.

Yet another feature of this invention is to provide an artificial coconut palm tree having a planar base, a central support, an exterior covering and a separable crown wherein the exterior covering comprises a stem portion and a butt portion, wherein the stem portion of the exterior covering is substantially greater in diameter than the central support and the bottom end of the butt portion of the exterior covering is substantially greater in diameter than the stem portion.

Yet another object of this invention is to provide an artificial coconut palm tree having a planar base, a central support, an exterior covering and a separable crown wherein the exterior covering comprises a stem portion and a butt portion wherein the butt portion is substantially conical and is blendingly tapered from the planar base to a first end of the stem portion, the butt portion simulating old growth.

It is still another object of this invention to provide a method of constructing a trunk portion of an artificial tree comprising the steps of forming a planar base, forming a central shaft, forming a support for the central shaft, affixing the support to the planar base and affixing one end of the central shaft to the support, forming a plurality of shaft support brackets, affixing one end of each of the plurality of the shaft support brackets to the planar base at a first distance from the central shaft, clamping an opposite end of each of the plurality of the shaft support brackets to the central shaft a specified distance above the planar base, forming a stem defining structure for said trunk portion, disposing the stem defining structure around the central shaft and covering the stem defining structure with at least one layer of an exterior coating wherein the shaft support brackets provide flexibility to the trunk portion.

Still another feature of this invention is to provide a stem defining structure for an artificial tree by forming a generally conical butt defining structure, forming a flange on a larger end of the conical butt defining structure, affixing the flange to the planar base around the plurality of shaft support brackets affixed to a base and a central shaft with the flange spaced from the central shaft, forming a plurality of shape defining elements, affixing at least one of the shape defining elements to the central shaft at a random location along the length of the central shaft, forming a flexible tube of a length substantially equal to the length of the central shaft, disposing the flexible tube telescopically over the central shaft and around the shape defining element(s), the flexible tube spaced from the central shaft at the random location by the shape defining element(s), inserting a lower end of the flexible tube through a truncated upper end of the conical butt defining structure with the lower end of the flexible tube resting on the plurality of the shaft brackets.

Yet another significant aspect of this invention is to provide a covering for the exterior surface of the trunk portion of an artificial tree by steps of forming an elongated tubular stem defining structure, covering the stem defining structure with a coarsening substance, drying the coarsening substance, applying an impermeable layer over the dried coarsening substance, applying a first coating of colored compound over the impermeable layer, the first coating establishing a base color for the trunk portion, applying a second colored compound containing finely divided particulate matter over the first coating and applying a third colored coating randomly over portions of said second coating.

It is readily apparent that another feature of this invention is to provide a method of constructing a crown portion of an artificial tree comprising the steps of forming a branch support base having a plurality of apertures therein for receiving the base stem of branches therethrough, forming a crown support on an underside of the branch support base wherein, the crown support is adapted to be affixed to a free end of a central shaft of an artificial tree, forming a plurality of branches, each branch having an elongated stem passing substantially through a centerline of the branch, forming a spear leaf portion, inserting the plurality of branches through the plurality of apertures seriatim in the branch support base, affixing the base end of the elongated stem in the branch support base, inserting the spear leaf in a central aperture in the branch support base, affixing the spear leaf in the branch support base and forming a bud about the branch support base.

DESCRIPTION OF THE PREFERRED EMBODIMENTS

While the various features of this invention are hereinafter described and illustrated as an artificial palm tree having a planar base, a central support, an exterior covering and a top wherein the central support has one end flexibly affixed to the planar base, the exterior covering being constructed around the central support and wherein the top portion is affixed to an opposite end of the central support, it is to be understood that the various features of this invention can be used singly or in various combinations thereof to provide an artificial tree having a planar base, a central support, an exterior covering and a top affixed to an end of the central support, as can hereinafter be appreciated from a reading of the following description.

Figure 1:
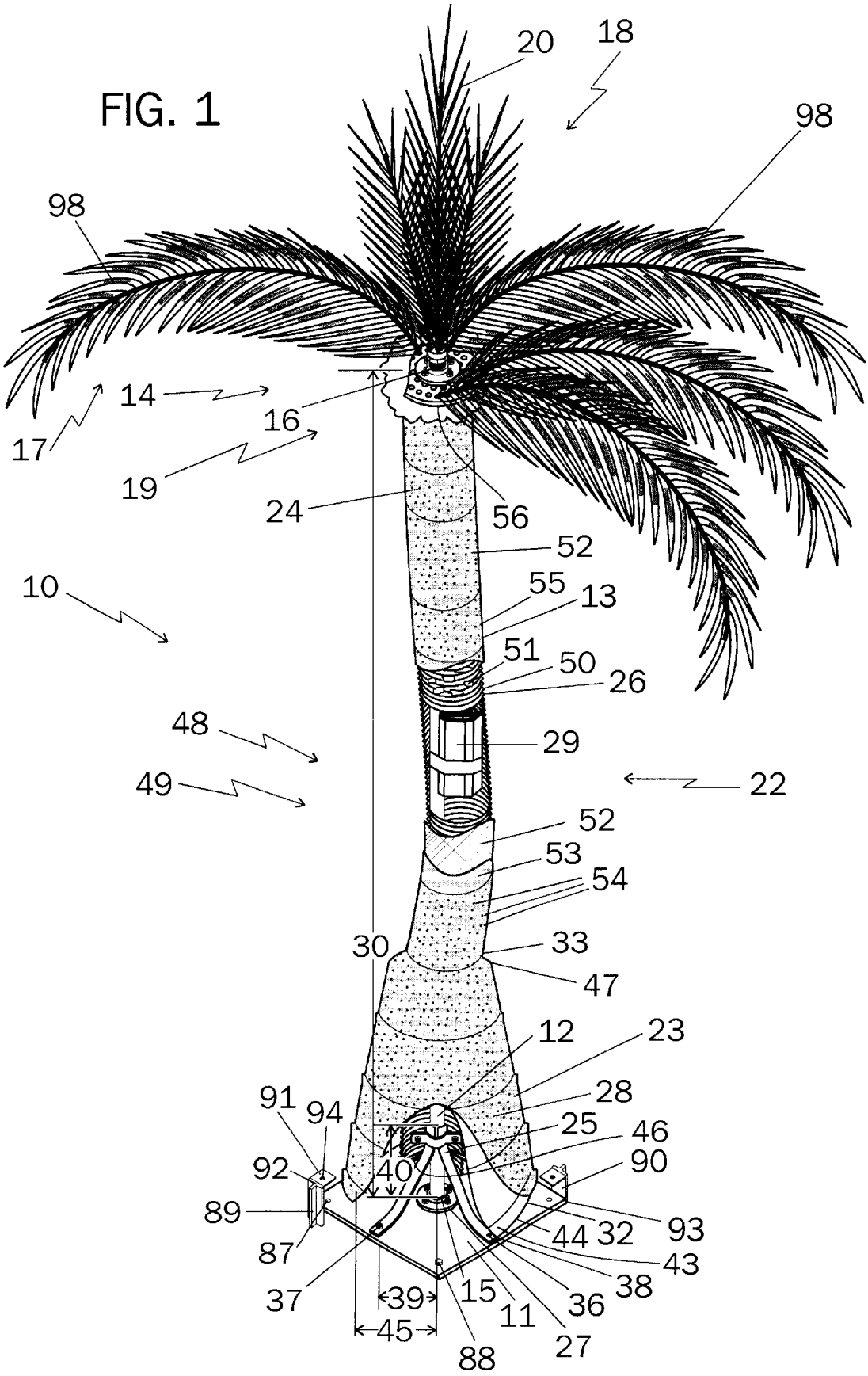
FIG. 1 is a perspective view of the preferred embodiment of the artificial tree of this invention with portions of the trunk broken away to view the internal structure thereof.

Referring now to FIG. 1, an artificial tree is generally shown by the FIG. 10. Artificial tree 10 has a planar base 11, a central support 12, an exterior covering 13 and a top portion 14, central support 12 having one end 15 flexibly affixed to planar base 11 and top portion 14 affixed to an opposite free end 16 thereof Central support 12 has exterior covering 13 constructed therearound, exterior covering 13 extending into top portion 14 at opposite end 16. Artificial tree 10 has top portion 14 preferably removably affixed to opposite end 16 of central support 12 wherein top portion 14 may be removed and replaced with an artificial top portion 14 of a different tree type. Preferably, top portion 14 simulates the crown 18 of a palm tree wherein crown 18 has fronds 17, a bud 19 and a spear leaf 20, fronds 17 extending generally outwardly from crown 18 and wherein some fronds 17 also curve outwardly and downwardly from crown 18. Bud 19 comprises the lower and lower central portion 21 of crown 18 with spear leaf 20 extending generally upwardly from bud 19. Thus, artificial tree 10 is made to simulate a palm tree and more specifically a coconut palm tree.

Central support 12 of artificial tree 10 is generally a straight member such as an elongated section of tubing and therefore has exterior covering 13 spaced from central support 12 in order to provide the general shape for a tree trunk 22. Tree trunk 22 is thus composed of exterior covering 13, central support 12, support brackets 25, conical shape 28, flexible elongated tubing 26 and support flange 27. Exterior covering 13 comprises a butt portion 23 and a upper trunk portion 24 of tree trunk 22 and is covered with color and texture shaping material to simulate tree trunk 22 of artificial tree 10. In artificial tree 10, exterior covering 13 is spaced from central support 12 with shape defining elements 29 affixed to central support 12 at selected spacings along the length 30 of central support 12 between ends 15, 16 wherein the selected spacings are generally disposed at unequal distances along length 30. Additionally, shape defining elements 29 are also disposed at and affixed to central support 12 at selected spacings about the periphery 31 of central support. Preferably, shape defining elements 29 are disposed at these selected spacings along length 30 and about periphery 31 at random. It is also within the scope of this invention to provide shape defining elements 29 which are unequal in size. Thus it is abundantly clear here, that by providing randomly sized shape defining elements 29 at random locations along length 30 and about periphery 31, each artificial tree 10 takes on a different shape to trunk portion 22 as exterior covering 13 is disposed about central support 12 in differing, random placements.

Artificial palm tree 10 having planar base 11, central support 12 and exterior covering 13 preferably also has crown 18 separable from trunk portion 22 and hence removably affixed to opposite end 16 of central support 12. With separable crown 18 removably affixed to end 16 of central support 12 and central support 12 flexibly affixed to planar base 11 at one end 15, artificial palm tree 10 may be shipped in disassembled fashion and reassembled at a location desired by the owner thereof In fact, several artificial palm trees 10 may be so shipped and assembled at a given location to simulate a grove of artificial palm trees 10 and as central support 12 is flexibly affixed to planar base 11 of each artificial tree 10, each artificial palm tree 10 in the grove of artificial palm trees 10 will move according to the shape of trunk portion 22, its mounting of flexible support brackets 25, its orientation with respect to the prevailing wind and the particular shape and contour of separable crown 18.

Referring to the broken away portion in FIG. 1, trunk portion 22 of artificial tree 10 having exterior covering 13 comprises a upper trunk portion 24 and a butt portion 23 wherein upper trunk portion 24 of exterior covering 13 is substantially greater in diameter than central support 12 and wherein the bottom end 32 of butt portion 23 is substantially greater in diameter than upper trunk portion 24. For instance, for shorter artificial trees 10 up to about fifteen feet in total height, central support is generally about one inch in diameter wherein upper trunk portion 24 of exterior covering 13 is from four to five inches in diameter whereas with taller trees, central support 12 may be about two or 2½ inches in diameter using a four to five inch diameter exterior covering 13. Of course, larger diameter trees may be made around central support by increasing the diameter of upper trunk portion 24 and thus the diameter of upper trunk portion 24 is still much greater in diameter than central support. Therefore, the relationship that the diameter of exterior covering 13 being much greater than the diameter of central support would hold for any size artificial tree 10 according to the teachings of this invention. Also, butt portion 23 of artificial palm tree 10 is substantially conical and is blendingly tapered from planar base 11 to a first end 33 of upper trunk portion 24 and when completely finished according to the teachings herein, butt portion 23 simulates the old growth of a natural palm tree.

Referring again to FIG. 1 and especially to the broken away section, a method of constructing trunk portion 22 of artificial tree 10 comprises the steps of forming a planar base 11 from a one-half or three quarter inch thick thermoplastic plate and providing four mounting holes in the corners thereof Preferably, base 11 is about 16 inches square though the size and shape may be varied and preferably would be greater for larger trees. Planar base 11 may be made from thermoplastics such as polyethylene, polypropylene, polyamide, polytetrafluoroethylene, polyparabenzamide or other engineered plastics or blends thereof including, but not limited to recycled thermoplastics. Furthermore, planar base 11 could be made of wood, wood/thermoplastic composites or metals but thermoplastics are preferred because of the long term stability of these materials. Central shaft 12 is preferably formed from a straight section of 1" diameter black iron pipe threaded on both ends 15, 16, a straight section substantially easier to use in the construction of artificial tree 10. Central shaft 12 may be bent after completion of artificial tree 10 in order to simulate a grove of trees having formed by the environment such that all trees in the grove have similar characteristics. Central shaft 12 may be made of other materials including other metals, wood or thermoplastics however it has been found by the inventor hereof that the black iron pipe is simple to use, cost effective to purchase and may be bent easily to various shapes after construction of artificial tree 10. For taller artificial trees 10, a flag pole or larger diameter pipe may be used. Next a support flange 27 for central shaft 12 is formed as a three inch diameter, four bolt pipe flange having a one inch threaded hole in the center thereof for receiving central shaft 12. Support flange 27 is affixed to planar base 11 by match drilling holes through planar base 11 through the four bolt flange and placing carriage bolts 34 therethrough. Preferably, support flange 27 is affixed approximately in the center of planar base 11 such that a conical butt defining structure 42 may be constructed around central shaft 12 and affixed to planar base 11. Central shaft 12 has one end 15 affixed to support flange 27 by threading one end 15 into threaded hole 35 in support flange 27.

Proceeding with construction of artificial tree 10, a plurality of shaft support brackets 25 are formed from one inch wide, ⅛ inch thick steel strap having short sections at each end 38, 41 bent at a 45 degree angle such that support brackets 25 may be affixed to planar base 11 and to central shaft 12. A hole 36 is provided through one end 38 of each support bracket 25 for receiving a bolt 37 therethrough, bolt 37 shown inserted into hole 36 of one bracket but removed from another hole 36 for clarity. Support brackets 25 are preferably identical in size with angles bent at the same distance from each end 38, 41 to facilitate assembly of artificial tree 10 and provide symmetric support thereto, however, it is certainly within the scope of this invention to make support brackets 25 of different size or being bent at different angles or a combination thereof to provide for asymmetric support of central shaft 12. One end 38 of each of shaft support brackets 25 is affixed to planar base 11 at a first distance 39 from central shaft 12 and the other end 41 is clamped to central shaft 12 a specified distance 40 above planar base 11. Clamping of other ends 41 of shaft brackets 25 may proceed in any conventional manner such as encircling ends 41 thereof with a hose clamp and tightening same upon ends 41 thereby affixing ends 41 to central shaft 12, however it has been found that a common chain link fence gate latch clamp (not shown) is best suited as the ends of the gate clamp may be firmly engaged with steel bolts (not shown) thus firmly affixing ends 41 to central shaft 12. By affixing ends 41 to central shaft 12 and ends 38 to planar base 11, support is given to central shaft 12, however because distance 40 is relatively short in relationship to length 30 and the CRS strap of support brackets 25 is malleable, a certain amount of flexure is provided and therefore artificial tree 10 is made flexible upon planar base 11.

Forming and finishing tree trunk 22 begins with forming a generally conical butt defining structure 42 having a flange 43 formed on a larger end 44 of conical butt defining structure 42, flange 43 affixed to planar base 11 around support brackets 25 with flange 43 spaced from central shaft 12 a second distance 45 wherein second distance 45 is greater than first distance 39. Thus, ends 38 of support brackets 25 are contained within the periphery of flange 43 and are hidden from view and protected from the elements. Flange 43 is preferably affixed to planar base 11 with half inch long number 8 wood screws driven through flange 43 into planar base 11 though it is also possible to adhesively affix flange 43 to planar base 11 or attach same in another suitable manner. Tree trunk 22 is generally not straight as has been previously provided in prior art artificial trees and thus a means for shaping trunk 22 is provided in the instant invention. First, a plurality of shape defining elements 29 are formed. One method for forming shape defining elements 29 is to roll a free length of cardboard to a suitable diameter and affix the free end to the roll. Thereafter, shape defining element 29 may be affixed to central shaft 12 at any random location along the length 30 or around the periphery 31 thereof by taping shape defining element 29 at the selected location with a length of duct tape. Other means for forming shape defining elements 29 are possible within the scope of this invention, for instance, it is possible to cut shape defining elements 29 from blocks of Styrofoam packing, to mold shape defining elements 29 into defined blocks or blobs of various shape and/or size in fixed molds and tape on in a similar manner or to foam a mass of foam insulation directly onto central shaft 12, these examples cited here for reference though the invention herein is limited thereto. Use of duct tape is an expedient manner of affixing at least one of shape defining element 29 to central shaft 12 at any random location along the length 30 thereof but other means such as clamping, gluing or direct forming are also within the scope of this invention. A flexible tube 26 of a length substantially equal to the length 30 of central shaft 12 is formed from a thermoplastic material, elongated tubing 26 preferably purchased from plumbing supply houses as 4" corrugated drain tubing though a smooth exterior flexible tubing section would as easily suffice. It also possible to use perforated tubing as long as elongated tubing 26 has some flexibility to allow artificial tree 10 to sway in the wind and also to facilitate assembly of elongated tubing 26 telescopically over central shaft 12 and around shape defining elements 29. Shape defining elements 29 are affixed to central shaft 12 such that the thickness thereof plus the diameter of central shaft spaces one edge of flexible elongated tube 26 from central shaft at the random location previously chosen by the aforementioned sum and upon completion of the location of all shape defining elements 29, flexible elongated tube 26 has the lower end 46 thereof inserted into truncated upper end 47 of conical butt defining structure 42 with lower end 46 of flexible tube 26 resting on shaft brackets 25. Some shape defining elements 29 along with the diameter of central shaft 12 may be sized to space the edge of flexible tube 26 in contact with space defining element 29 a maximum distance from central shaft 12 wherein the opposite side of flexible tube 26 is in contact with central shaft 12 opposite shape defining element 29 while other shape defining elements 29 may space flexible tube 26 a smaller distance from central shaft 12. Flexible tube 26 thus assembled over shape defining elements 29 around central shaft 12 and resting on support brackets 25 comprises a stem defining structure 48 for trunk portion 22. Stem defining structure 48 is affixed to truncated end 47 of conical butt defining structure 42 by suitable means and thus stem defining structure 48 and butt defining structure 42 comprises a trunk defining structure 49 for trunk portion 22. Trunk defining structure 49 has the exterior surface 50 thereof covered with a coarsening substance 51 which is thereafter dried to provide an uneven surface to trunk defining structure 49 as would appear on a natural tree. An impermeable layer 52 is applied over dried coarsening substance 51 and a first coating 53 of colored compound, such as roofing cement, is applied over impermeable layer 52 wherein first coating 53 establishes a base color for trunk portion 22. A natural look and feel is imparted to trunk portion 22 by applying a second colored compound 54 containing finely divided particulate matter over first coating 53 whereafter a darker third colored coating 55 is randomly applied over portions of second coating 54 to achieve a weathered look. Tree trunk 22 may be shipped separately after assembly thereof or may have top portion 14 applied thereto before shipment. Though trunk 22 has some curvature thereto by the selective placement of shape defining elements 29 displacing elongated tubing 26 out of a concentric relationship with central shaft 12, trunk 22 is still generally straight as central shaft 12 is straight. However, since central shaft 12 is relatively small in diameter to elongated tubing 26, central shaft 12 may be displaced from its straight condition either during construction of artificial tree 10 or preferably after completion thereof but just prior to emplacement of artificial tree 10 in its permanent location. One method of bending central shaft 12 prior to erection will hereinafter be fully explained.

Conical shape 28 may be made of sheet material of metal, plastic or wood wrapped into a truncated cone having the edges thereof joined to make a free standing cone. Flange 43 may be formed from the sheet of material at the larger end 44 thereof or may be separately formed and affixed thereto. Furthermore, conical shape 28 may be molded from a suitable material or may be constructed of stacked elements of different size. Coarsening substance 51 is preferably joint taping compound applied to open weave joint tape but may also be chunks of solid material affixed elongated tubing 26. Other means of providing a rough texture to elongated tubing 26 is certainly within the scope of this invention. Impermeable layer 52 is preferably an EPDM roofing material cut into approximately 4 inch wide strips providing for ease of wrapping at least one, but preferably only a single ply thereof, over coarsening substance 51. Impermeable layer 52 is affixed to elongated tubing 26 at upper end 56 thereof, upper end 56 approximately even with opposite end 16 of central shaft 12. First coating 53 is preferably a tan colored roofing latex roofing cement but may be paint or a thin, colored wrap. Second coating 54 is similar to first coating 53 however particulate matter such as sand, metal grindings, wood dust or the like is added thereto in order to give a grit like texture to tree trunk 22. Finally, second coating 54 is highlighted by lightly applying a dark brown paint to some raised portions of tree trunk 22. One method of applying third coating 55 is to apply the dark brown paint to a separate cloth material and hand wiping the separate cloth with dark brown paint thereon upon tree trunk 22.

Figure 2:
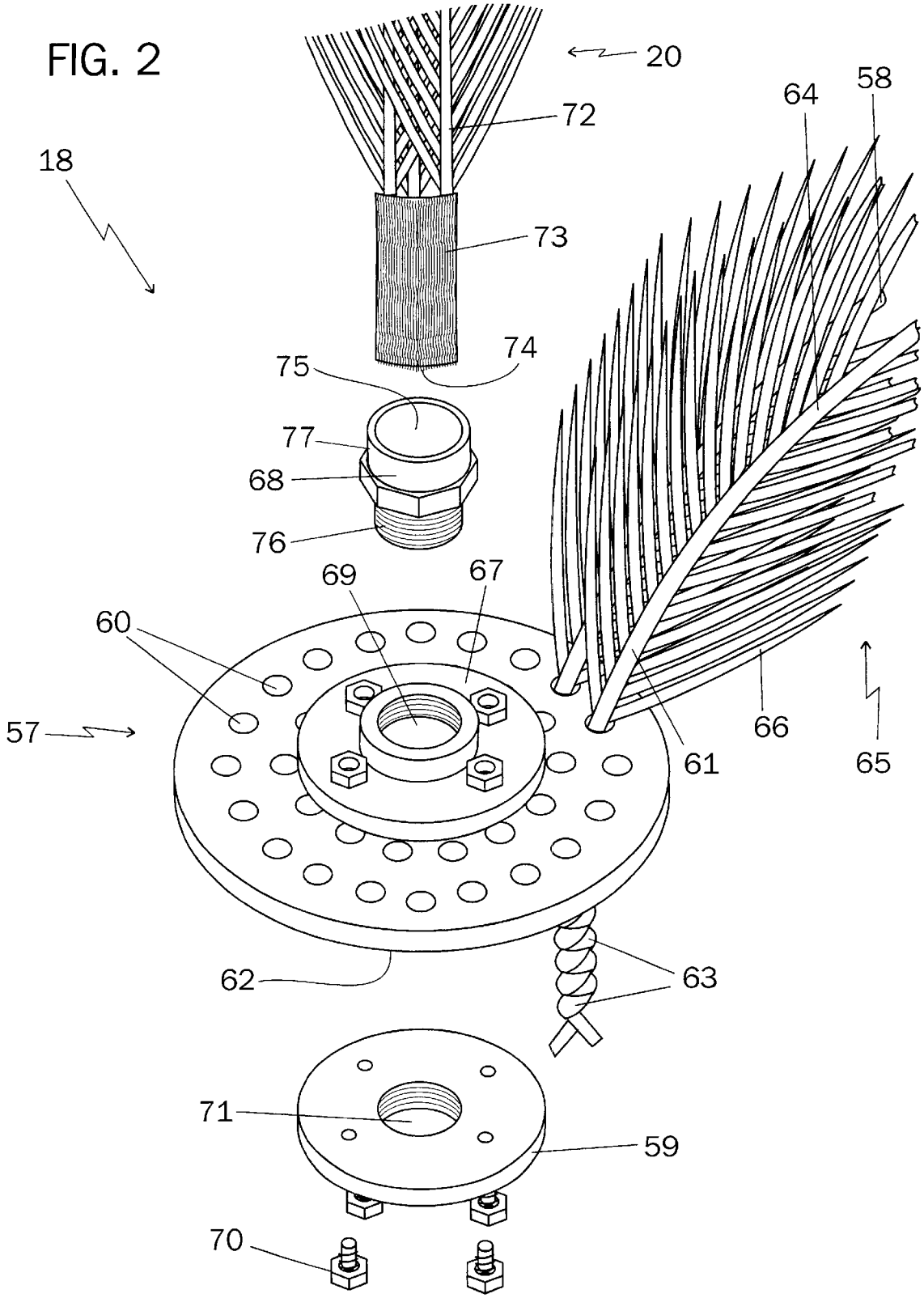
FIG. 2 is an exploded perspective view of one embodiment of the crown for the artificial tree of FIG. 1 to view the internal structure thereof.
Figure 3:
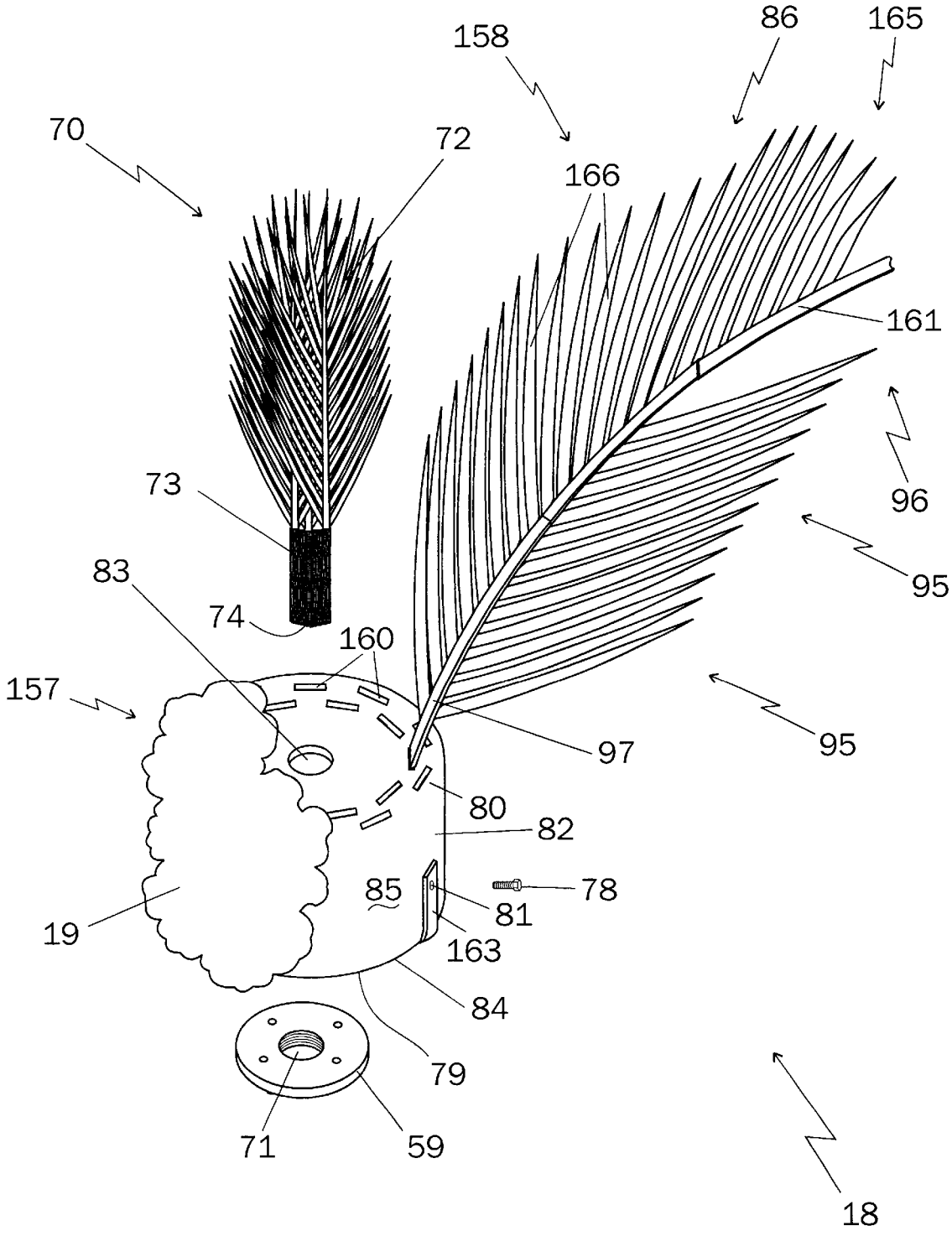
FIG. 3 is an exploded perspective view of another embodiment of the crown for the artificial tree of FIG. 1 to view the internal structure thereof.

A method of constructing a crown portion 18 artificial tree 10 comprises the steps of forming a branch support base 57, a plurality of branches 58, a crown support 59, a spear leaf portion 20 and a bud 19 wherein branch support base 57 has a plurality of apertures 60 therein for receiving the end 63 of base stem 61 of branches 58 therethrough. Branch support base 57 is formed from a 6" diameter thermoplastic drain grate available along with crown support 59, spear leaf support 67 and spear leaf adapter 68 at many plumbing supply outlets and or hardware stores. Crown support 59 is disposed on an underside 62 of branch support base 57, crown support 59 adapted to be affixed to free end 16 of central shaft 12 of trunk portion 22 of artificial tree 10. Crown support 59 is formed as a three inch diameter, four bolt pipe flange having a one inch threaded hole 71 in the center thereof for receiving central shaft 12 therein when artificial tree 10 is fully assembled. Likewise, spear leaf support 67 is also formed as a three inch diameter, four bolt pipe flange having a one inch threaded hole 69 in the center thereof for receiving spear leaf receiver 68 therein, spear leaf receiver 68 comprising a 1" NPT pipe to 1" thermoplastic tubing adapter. Preferably, spear leaf support 67 and crown support 59 are bolted together through four apertures 60 in branch support base 57 with bolts 70. Each of the plurality of branches 58 has an elongated stem 61 passing substantially through a centerline 64 of branch 58, elongated stem 61 having a leaf end 65 and a base end 63. Leaf end 65 has at least one leaf 66 formed on a major portion of elongated stem 61, base end 63 being substantially free of leaf 66 on a minor portion of elongated stem 61. Branches 58 may be purchased as complete wherein leaves 66 are molded on leaf end 65 over elongated base stem 61 or branches 58 may be made by applying leaves 66 to leaf end 65 with an adhesive. In the embodiment in FIG. 2, stem end 63 of each of the plurality of branches 58 is inserted through one of the plurality of apertures 60 seriatim in branch support base 57, ends 63 affixed of elongated stem 61 in branch support base 57, branches 58 initially extending generally directly upwardly. As shown in FIG. 2, ends 63 of adjacent pairs of elongated stems 61 are twisted together on underside 62 of branch support base 57. Twisted ends 63 are then tucked under underside 62 prior to forming bud 19 therearound as will be hereinafter explained. Branches 58 are bent outwardly and downwardly upon completion of artificial tree 10, preferably at the location chosen for placement of artificial tree 10. As branches 58 may be bent with some force, the configuration of artificial tree 10 may be changed to suit the particular owner. Referring both to FIGS. 2 and 3, spear leaf portion 20 comprises a plurality of thermoplastic leaves 72 extending generally upwardly and surrounded at the base 74 thereof with natural or synthetic cocoa fiber. Spear leaf portion 20 has a portion of end 74 and the surrounding cocoa fiber inserted into the plastic pipe end 75 of spear leaf adapter 68 after threaded end 76 of spear leaf adapter 68 has been threaded into spear leaf support 67. Spear leaf portion 20 may be further retained in spear leaf adapter 68 by passing a screw through the wall 77 and into or through end 74 and cocoa fiber 73. Furthermore, spear leaf portion 20 may have spear leaf adapter 68 molded or adhered to end 74 without departing from the scope of this invention.

Referring now to FIG. 3, branch support base 157 is formed from a 6" diameter inverted thermoplastic pipe cap and has slot like apertures 160 formed through the top 80 thereof adapted to receive flat stem ends 163 of flat stem branches 158, branches 158 hereinafter described. Flat stem ends 163 pass through apertures 160 and are preferably bent around the bottom lip 84 of branch support base 157, upwardly alongside the outer periphery 85 of wall 82 and affixed thereto with screws or bolts 78 passed through hole 81 in stem end 163. As flat stem branches 158 are firmly affixed to wall 82 of branch support 157, a more durable crown 18 is provided for artificial tree 10. As purchased branches 58 are molded around a round wire used as elongated base stem 61, there is a tendency for branches 58 to pivot in apertures 60 formed through branch support base 57 and hereinbefore mentioned, it is preferred that branches 58 are formed over a flat piece of ⅛" thick, ½" wide steel plate wherein the flat steel plate becomes elongated stem 161 thus forming branches 158 as shown in FIG. 3. Branches 158 are then retained in slot like apertures 160 and therefore branches 158 retain not only the intended shape thereof but also are substantially prevented from rotating within apertures 160. Leaves 166 may be applied to flat elongated stem 161 in any suitable manner and may be formed first as a leaf structure 86 having no stem and thereafter physically affixed to leaf end 165 of flat elongated stem 161. As with branch support 57 of FIG. 2, branch support 157 of FIG. 3 has crown support 59 affixed thereto and specifically has crown support 59 affixed to underside 79 of top 80 with bolts 70, however, bolts 70 pass only through top 80 as no spear leaf support 67 is affixed to top 80 as it is largely unnecessary because end 74 of spear leaf portion 20 may be fitted in end 16 of central shaft 12. It is entirely possible however, to also provide spear leaf adapter 68 threading threaded end 76 into crown support 59 through hole 83 in top 80.

Crown 18 of either FIG. 2 or FIG. 3 is completed by forming a bud 19 about branch support base 57, 157, ends 63, 163, crown support 59, spear leaf support 67 and spear leaf adapter 68 and across top 80 such that these parts 57, 157, 59, 63, 163, 67, 68 and 80 are hidden from view. Thus, bud 19 has base end 63, 163 of branches 58, 158 and base end 74 of spear leaf portion 20 embedded in bud 19, bud 19 may be formed of a foamed thermoplastic material available at plumbing supply stores and hardware stores. The foamed thermoplastic material forming bud 19 is applied as multiple layers of random dollop shaped portions spaced around trunk portion 22. In FIG. 2, bud 19 is generally formed about branch support base 57 after crown 18 is affixed to opposite end 16 of central shaft 12 whereas in FIG. 3, bud 19 may be formed about branch support cup 157 and upon completion of assembly of crown 18. In either case, bud 19 is then painted with a dark brown paint to simulate the bud on a natural palm tree. Branches 58, 158 may be selected from the group comprising preserved palm fronds, cut palm fronds and artificial palm fronds but preferably, branches 58 are purchased and branches 158 are formed from flat, colored thermoplastic sheet stock and die cut into leaf structure 86. Leaf structure 86 preferably has a flat central section 97 adapted to be adhesively affixed to flat stem 161 on leaf end 165. Preferably, leaf structure 86 comprises at least one straight section 95 applied to flat stem 161 near end 163 and a tapered end section 96 applied over terminal end of leaf end 65. Thus, longer branches 158 for taller artificial trees 10 may be constructed by applying multiple straight sections 95 end to end beginning at stem end 163 terminating in one tapered end section 96. In this preferred embodiment, sections 95, 96 are approximately 22 inches in length and thus branches 158 are made in multiple lengths of 22 inches, though of course, straight sections 95 may be cut to any length to construct a branch 158 of a length not a full multiple of 22 inches. It is also possible to cut section 96 in a like manner. Preferably also, a portion 98 near the tips of leaves 66 of tapered end section 96 are highlighted with a contrasting color such as yellow. Though a palm tree has been recited as the preferred embodiment of this invention, crown 18 for other tree types may be prepared in a similar manner.

Though bud 19 has been described as random layers of thermoplastic foam applied around upper portion 56 of trunk portion 22 and/or around crown support base 57, 157, it is preferred that bud 19 be formed of natural or synthetic cocoa fiber wound around crown support base 57, 157 and/or upper portion 56. Bud 19 may further include a bulking material first placed around crown support base 57, 157 and/or upper portion 56 to space the cocoa fiber from crown support base 57, 157 and/or upper portion 56 as would appear in a natural palm tree. Bud 19 may be formed by winding individual cocoa fibers, multiple strands or a woven fabric around support base 57, 157 and/or upper portion 56 and may additionally be formed by first applying elongated gathered fibers to specific locations around support base 57, 157 and/or upper portion 56 and thereafter applying a woven fabric of cocoa fibers therearound. Other bunches of cocoa fiber may be applied to ends 63, 163 of branches 58, spear leaf adapter 68 and spear leaf 20. For other types of artificial trees 10 such as those listed hereafter, the transition portion between upper trunk portion 24 and top portion 14 may be simulated by applying various materials to upper portion 56 and/or support base 57, 157.

Alternate trees made by the methods described herein include but are not limited to Banana tree, palm, Redwood, Sequoia, Eucalyptus, or any other tree having a generally elongated trunk portion 22 and a concentrated top portion 14 wherein the bulk of the leaves 66 and or branches 58 are concentrated near the upper end 56 of a trunk portion 22. For instance, a banana tree has a spear leaf 20 but no external bud 19 as the spear leaf 20 appears to grow directly from the upper end 56 of trunk portion 22. Redwoods, including the Giant Sequoia, have large diameter, long trunk portions 22 with the crown portion 18 near the top 14 of the tree, however, no spear leaf 20 is present and, in fact, many redwoods have the central portion 21 of top portion 14 missing, having been struck by lightning. It is within the scope of this invention to provide a crown 18 when building such an artificial tree 10. Within the palm family, many palm trees may be constructed according to the teachings of this invention. For instance, Chamaerops Humilis, Trachycarpus Fortunei and Trithrinax Campestris may be constructed by providing a shorter, stockier trunk portion 22 by using a greatly enlarged flexible tubing 26 over central support 12 and a crown portion 18 of shorter fronds 17, fronds 17 primarily extending upwardly in a bowl like formation wherein bud 19 may not be visible. In addition, some palms have a much longer butt portion 23 than upper trunk portion 24, these artificial trees 10 fully within the scope of this invention.

When erecting artificial tree 10 of this invention, planar base 11 is adapted to be affixed to a solid foundation such as a concrete slab by passing bolts 88 through holes 87 in planar base 11 and driving bolts 88 into concrete anchors (not shown) though artificial tree 10 may also be placed upon a flat surface such as an indoor floor and left there without bolting same in place. Preferably, though for outdoor use, planar base 11 is placed upon the surface of the ground where artificial tree 10 is desired and affixed thereto with several stakes 90. Stakes 90 are T-shaped fence line posts 89 having a flat bracket 91 affixed to the top end 92 thereof Flat bracket 91 is preferably welded to top end 92 and has a hole 94 provided therethrough for attaching planar base 11 to bracket 91 with bolts 88, though it is generally not necessary to use bolts 88. Once artificial tree 10 is located on the surface of the ground, stakes 90 are driven into the ground adjacent corners 93 of planar base 11 with bracket 91 overlying planar base 11. By using a stake 90 at each corner 93, artificial tree 10 may be firmly affixed to the surface of the ground wherein installation is completed by covering planar base 11 and stakes 90 with earth similar to the surrounding surface of the ground. As artificial tree 10 is firmly affixed to the ground, it has been found by the inventor hereof that a wind of 80 miles per hour does not dislodge artificial tree 10 from its mooring.

Some owners of artificial tree 10 may elect to have a grove of artificial trees 10 appear to be wind swept or otherwise shaped by the elements. Thus, artificial tree 10 of this invention may have trunk portion 22 bent to shape prior to installation upon the desired surface. To bend trunk portion 22 of artificial tree 10, trunk portion 22 may be suspended between two supports and a force applied to trunk portion 22 sufficient to bend central shaft 12. Thus, in addition to having shape defining elements 29 provide a certain curvature to tree trunk 22 in specified locations along the length 30 thereof, at least one additional bend may be provided therein. By bending more than one artificial tree 10 in approximately the same location along length 30 of central shaft 12, a grove of trees may be simulated. Of course, it is also possible to bend trunk portion 22 in more than one place by the method recited. As artificial trees 10 may be shaped in various ways, fitted with various top portions, have individual bud portions 19 applied thereto, made of various height, circumference, coverings and colors, artificial trees 10 made by the teachings of this invention are thus individual constructions and hence are all different.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. An artificial tree having a planar base, a central support, an exterior covering and a top, said central support having one end thereof flexibly affixed to said planar base with a plurality of support brackets, said exterior covering thereafter constructed around said central support and said support brackets, said top portion thereafter affixed to an opposite end of said central support.

2. An artificial tree as in claim 1 wherein said exterior covering is spaced from said central support.

3. An artificial tree as in claim 2 wherein said exterior covering is spaced from said central support with shape defining elements affixed to said central support, said shape defining elements disposed between said central support and said exterior covering, said shape defining elements displacing said exterior covering out of a concentric relationship with said central support.

4. An artificial tree as in claim 3 wherein said shape defining elements are affixed to said central support at selected spacings along the length of said central support.

5. An artificial tree as in claim 4 wherein said selected spacings are unequal along the length of said central support.

6. An artificial tree as in claim 5 wherein said selected spacings along said length are random.

7. An artificial tree as in claim 3 wherein said shape defining elements are affixed to said central support at selected spacings about the periphery of said central support.

8. An artificial tree as in claim 7 wherein said selected spacings are unequal about said periphery of said central support.

9. An artificial tree as in claim 8 wherein said selected spacings about said periphery are random.

10. An artificial tree as in claim 3 wherein said shape defining elements are unequal in size.

11. An artificial tree having a planar base, a central support, an exterior covering and a separable crown, said central support having one end thereof flexibly affixed to said planar base with a plurality of support brackets, said exterior covering thereafter constructed around and spaced from said central support and said support brackets, said separable crown thereafter removably affixed to an opposite end of said central support.

12. An artificial tree as in claim 11 wherein said separable crown is removably affixed to said central support wherein said separable crown is removed and replaced with an artificial separable crown of a different tree type.

13. An artificial tree as in claim 12 wherein said separable crown simulates a palm tree.

14. An artificial tree as in claim 13 wherein said separable crown simulates a coconut palm tree.

15. An artificial tree as in claim 13 wherein said separable crown has fronds, a bud and a spear leaf, said fronds extending generally outwardly from said crown, said bud comprising a lower central portion of said crown, said spear leaf extending generally upwardly from said bud.

16. An artificial palm tree as in claim 14 wherein said artificial coconut palm tree has said exterior covering comprising a stem portion and a butt portion.

17. An artificial palm tree as in claim 16 wherein the inside diameter of said stem portion of said exterior covering is substantially greater in diameter than said central support.

18. An artificial palm tree as in claim 17 wherein the bottom end of said butt portion of said exterior covering is substantially greater in diameter than said stem portion.

19. An artificial palm tree as in claim 18 wherein said butt portion is substantially conical and is blendingly tapered from said planar base to a first end of said stem portion, said butt portion simulating old growth.

* * * * *